United States Patent [19]

Nelson

[11] 4,089,230

[45] May 16, 1978

[54] WASTE AND OVERFLOW PLATE ASSEMBLY

[75] Inventor: Merritt J. Nelson, Sparta, Mich.

[73] Assignee: Zin-Plas Corporation, Comstock Park, Mich.

[21] Appl. No.: 707,817

[22] Filed: Jul. 22, 1976

[51] Int. Cl.[2] ..... F16H 21/26; E03C 1/23

[52] U.S. Cl. ..... 74/97; 74/520; 74/526; 4/199; 4/206

[58] Field of Search ..... 4/199, 198, 206; 74/97, 74/97 P, 100 R, 100 P, 520, 526; 200/339, 334

[56] References Cited

U.S. PATENT DOCUMENTS

| | | | |
|---|---|---|---|
| 1,736,849 | 11/1929 | Douglas | 74/523 |
| 1,763,690 | 6/1930 | Edgar et al. | 74/523 |
| 2,327,393 | 8/1943 | Beeke et al. | 4/199 |
| 2,486,246 | 10/1949 | Beeke | 74/97 |
| 3,125,764 | 3/1964 | Young | 4/204 |
| 3,162,060 | 12/1964 | Van Noord | 74/100 X |
| 3,551,921 | 1/1971 | Fox et al. | 74/97 X |

*Primary Examiner*—Carlton R. Croyle
*Assistant Examiner*—Richard E. Gluck
*Attorney, Agent, or Firm*—McGarry & Waters

[57] ABSTRACT

A waste and overflow plate assembly for a lavatory drain includes a plate with an aperture therethrough and a lever toggled in the face plate aperture. A U-shaped spring clip is retained by a securing pin on the back portion of the lever member between the securing pin and the face plate to toggle the lever into two positions. A retaining pin is positioned on the back portion of the lever between the legs of the clip to prevent pulling and twisting of the lever member with respect to the plate.

7 Claims, 7 Drawing Figures

WASTE AND OVERFLOW PLATE ASSEMBLY

BACKGROUND OF THE INVENTION

1. Field of the Invention

This invention relates to a waste and overflow plate assembly having a lever structure which can be pivoted between two positions and retained within its assembly.

2. Description of the Prior Art

Drain stop levers have been positioned through an overflow plate to provide for an aesthetically pleasing waste and overflow plate assembly which is functional in both draining off excess water from the top of a tube or a sink, and secondly in controlling a stopper located at the bottom of a tub or sink.

Different types of waste and overflow plate assemblies have been used. One type utilizes a lever handle which rotates about an axis perpendicular to the overflow plate.

Another type employs a toggled lever. The lever extends through a coil spring which is biased against the back of the overflow plate. The lever can be pivoted to one of two stable positions. One such assembly is disclosed in the U.S. Pat. No. 2,327,393 issued to Beeke et al on Aug. 24, 1943.

A third type of assembly utilizes a toggle lever used in conjunction with a V- or U-shaped spring clip. This third type of assembly is relatively cheaper and simpler to assemble than the one utilizing the relatively cumbersome coil spring. The spring clip has an elongated aperture through its two legs which allows the clip to be positioned over a back portion of the lever and maneuvered around a securing pin. The clip is retained by the securing pin when the elongated aperture is transverse to the securing pin.

The problem with the spring clip toggle mechanism has been that people have a tendency to mistake it for the first type of lever mechanism and attempt to rotate the handle, particularly when the handle has its central axis substantially parallel to the plane of the plate. The rotation of the lever will result in the alignment of the securing pin with the elongated aperture and the consequent loss of the spring engagement with the lever. To correct the loss of the spring, the plate must be removed from the tub or sink to which it is attached, and, if possible, the spring retrieved or a new spring positioned on the lever.

To eliminate the problem of rotation, manufacturers have squared off a portion of the lever which is positioned within the face plate aperture to prevent rotation of the lever. However, ingenious people, who refuse to believe that the lever was made to toggle instead of rotate, will pull out the lever, thereby disengaging the square portion of the lever from the aperture. The lever is then free to rotate, and the subsequent alignment of the securing pin with the spring clip aperture will result in the loss of the spring clip and the end of the successful operation of the spring clip assembly.

One such lever mechanism is disclosed in U.S. Pat. No. 3,162,060 issued to VanNoord on Dec. 22, 1964. The VanNoord reference discloses a trip lever which has a ball portion positioned within the aperture of the plate. Adjacent the ball portion is a squared portion which fits between two fulcrum extensions which prevents rotation of the lever. On the back portion of the lever, a V-shaped spring is secured by a securing pin. The lever toggles up and down into two stable positions.

Another similar device to the VanNoord device is disclosed in the U.S. Pat. No. 3,551,921 issued to Fox et al on Jan. 5, 1971. The structure is similar to the VanNoord device. A U-shaped spring is placed on the back portion of the lever and secured by a transverse pin.

SUMMARY OF THE INVENTION

According to the invention, a trip lever is positioned through an aperture of the face plate. The trip lever is moveable between two pivotable positions with respect to the face plate. A toggle means for toggling the trip lever between two pivotable positions on the face plate include a spring clip having two leg sections each of which has a slotted aperture therethrough, and means on an end of the trip lever biasing the spring between an end of the trip lever and the face plate.

The trip lever is stabilized against rotation when seated in the face plate.

A retaining means is placed on the trip lever and spaced from the face plate a distance so as to prevent withdrawal of the trip lever from engagement with the face plate. Preferably the retaining means is a front protuberance (hereinafter referred to as a "pin"). Preferably the retaining pin protrudes through the trip lever in a horizontal fashion. Desirably, the retaining pin is integrally formed with the trip lever.

Preferably, the spring is biased on two rearwardly extending protrusions of the face plate. In one specific embodiment, the protrusions are flat and triangular in shape, wherein the planes defined by the protrusions are in a vertical position, transverse through the face plate and parallel with respect to each other. The apex of the triangular protrusion is midway between the upper and lower edges and extending rearwardly.

Preferably, the trip lever has a ball portion which seats within the face plate at a point where the trip lever extends through the face plate. Preferably a squared portion of the trip lever is adjacent and to the rear of the ball portion wherein the sides of the squared portion are adjacent to the inside surfaces of the protrusions.

The face plate desirably has a slotted edge through which excess water may pass to a drainage channel. The face plate further has a central aperture and a ball seating means at the aperture.

Preferably, the retaining pin is transverse to the slotted aperture at the front leg of the spring clip, the retaining pin has a length greater than the width of the slotted aperture. The front leg of the spring clip is preferably positioned between the retaining pin and the protrusions of the face plate.

In one specific embodiment, the toggling means also includes a rear securing pin which is transverse to the slotted aperture of the rear leg of the spring clip. The slotted aperture has a length greater than the securing pin and a width shorter than the length of the securing pin. When the spring leg is rotated transversely with respect to the securing pin, the slotted aperture is rotated so that the spring is engaged by the securing pin so that the spring clip is biased against the protrusions.

In one specific embodiment, as the trip lever is toggled from one position to another and the spring clip is biased over the apex of the triangular protrusions, the retaining pin is positioned so that the front leg of the spring clip barely fits within the clearance between the retaining pin and the apexes of the protrusions. As the trip lever is in one position or the other, the front leg of the spring clip abuts the fulcrum edge of the protrusions, the clearance between the pin and front leg of the spring clip is less than the distance from the rear edge of the squared portion of the trip lever to the front edge of the protrusions. Such a positioning of the pin prevents the squared portion of the trip lever from becoming disengaged from the protrusions and thus prevents the rotation of the trip lever around an axis perpendicular to the face plate.

The invention limits any nonfunctional and detrimental movements of the trip lever which have, in the past, rendered the trip lever structures inoperative.

DESCRIPTION OF THE PREFERRED EMBODIMENTS

Figure 1:
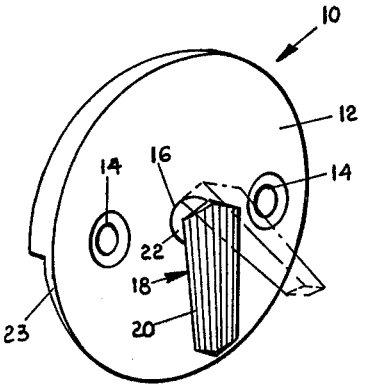
FIG. 1 is a front perspective view of a trip lever assembly according to the invention.

Referring to FIG. 1, the trip lever structure 10 has a face plate 12 having two side apertures 14 for screws to secure the face plate to the tub. A central socket 16 with an aperture therethrough is formed in the face plate 12. The bottom edge 23 of the face plate 12 is indented to form a slot through which excess water may pass to an operably connected drainage channel (not shown).

Figure 2:
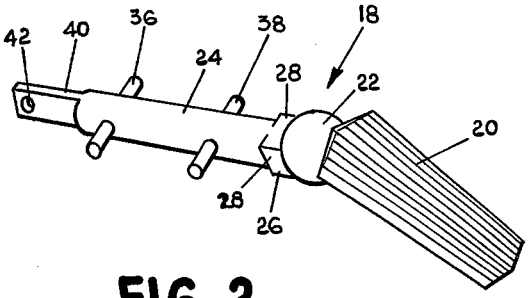
FIG. 2 is a perspective view of the lever member shown in FIG. 1.

A trip lever 18 is positioned through the central socket 16. The trip lever 18 has a front handle portion 20, which normally extends downwardly along the face plate 12, and a ball portion 22 which snugly rests within socket 16. Referring to FIG. 2, an arm portion 24 extends rearwardly from ball portion 22 at a substantially transverse angle to the handle portion 20. On the arm portion 24 adjacent to the ball portion 22 is a squared portion 26. The squared portion has its side surfaces 28 in a vertical and horizontal position when handle portion 20 is aligned on a vertical axis.

Figure 3:
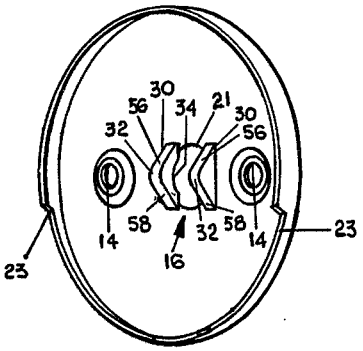
FIG. 3 is a rear perspective view of the face plate shown in FIG. 1.

Referring to FIG. 3, two planar triangular protrusions 30 protrude rearwardly from opposite sides of socket 16 so that the aperture 21 has two flat side edges. Each planar and triangular protrusion 30 has a vertical axis. Each triangular protrusion 30 has its apex 32 midway between the top and bottom edges of the protrusion 30. The apex 32 is the most rearward point of the protrusion 30. The triangular protrusion has edge 34 abutting socket 16. Edge 34 is indented to conform with the circularity of socket 16.

As shown in FIG. 2, arm portion 24 has two pins 36 and 38 which extend therethrough in a horizontal fashion. Securing pin 36 is placed near the rearward end of arm portion 24. Retaining pin 38 is positioned toward the squared portion 26. Pins 36 and 38 are integrally formed with trip lever 18.

The rear end of arm portion 24 is a flattened cotter pin portion 40 which has an aperture 42 extending horizontally therethrough. The drain connection (not shown) is coupled through a pin (not shown) to the arm portion 24 through aperture 42.

Figure 4:
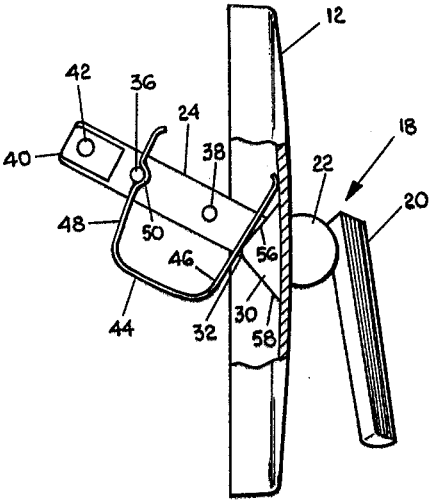
FIG. 4 is a partially broken side elevational view of the embodiment illustrated in FIG. 1.

Referring to FIG. 4, the trip lever 18 is positioned through socket 16 so the arm portion is to the rear of the protrusion 30 while handle portion 20 is to the front of the face plate 12. Ball portion 22 is positioned within socket 16 so that it is pivotally mounted in a vertical fashion.

A clip spring 44 is mounted on the arm portion 24 of trip lever 18. Spring clip 44 has one leg 46 in contact with the rear edges of protrusions 30. Leg 48 of spring clip 44 abuts securing pin 36. Spring clip leg 48 has a horizontal groove 50 which engages securing pin 36.

Figure 5:
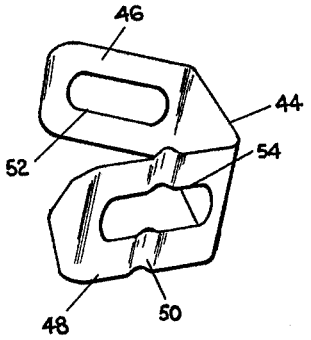
FIG. 5 is a perspective view of the spring clip shown in FIG. 4.

As shown in FIG. 5, spring clip 44 has slotted apertures 52 and 54 positioned on legs 46 and 48 respectively. Slotted apertures 52 and 54 are sufficiently long so that arm portion 24 and pins 36 and 38 can be placed therethrough when the pins are aligned with the slotted apertures 52 and 54.

Spring clip 44 is mounted on arm portion 24 so that securing pin 36 is transverse to the slotted aperture 54. Securing pin 36 is longer than the width of slotted aperture 54 so that pin 36 engages groove 50 on both sides of slotted aperture 54. Slot 52 has a width narrower than the distance between protrusions 30. Leg 46 abuts both protrusions 30. Retaining pin 38 has a length greater than the width of slots 54 and 52 and greater than the distance between the protrusions 30. Both pins 36 and 38 have a length shorter than the diameter of the circular socket 16 so as to allow easy assembly of the trip lever 18 through the face plate 12.

Trip lever 18 has a two-position toggle mounting wherein in one position arm portion 24 is inclined upwardly so that aperture 42 is in an up position. In the up position, as shown in FIG. 4, spring clip 44 rests against upper surface 56 of protrusions 30. As handle 20 is pulled upward, the arm portion is pivoted downwardly so that aperture 42 is in a lower position. When aperture 42 is in the lower position, spring clip leg 46 rests against surface 58 of protrusions 30.

If an operator mistakenly thought structure 10 was a rotational lever and attempted to rotate handle 20, squared portion 26, snugly fitted between protrusions 30, will prevent any rotation of handle 20. If an operator attempted to pull handle 20 forward to bring ball portion 22 out of aperture 16 and disengage rear portion 26 from the inner surfaces of protrusions 30, the operator would grab the handle 20 so that it will pivot slightly upwardly. The operator then would pull handle 20 forwardly. Retaining pin 38 will then be pulled forward to the point where it makes contact with leg 46 of spring clip 44 which is in contact with the inner edges 56 and of protrusions 30. When retaining pin 38 makes contact with spring clip leg 46, handle 20, is incapable of being pulled more forwardly. The limitation of the forward movement of trip lever 18 decreases the possibility that the trip lever will be pulled out and rotated. In this manner, pins 36 and 38 are prevented from realignment with slotted apertures 52 and 54 and resulting disengagement of the spring clip 44 from arm portion 24 of the trip lever 18.

Without the pin 38, as in the prior art structures, the trip lever was frequently rotated by mistake, thereby causing an alignment of the pins 36 with slot 54. Release of the spring 44 thereafter occured and the toggle mechanism was rendered inoperative. It was thereafter extremely difficult or practically impossible to reposition the pin 36 behind the spring leg 48 while the plate was still in the wall. Occasionally the spring was lost, rendering the trip assembly useless.

Figure 6:
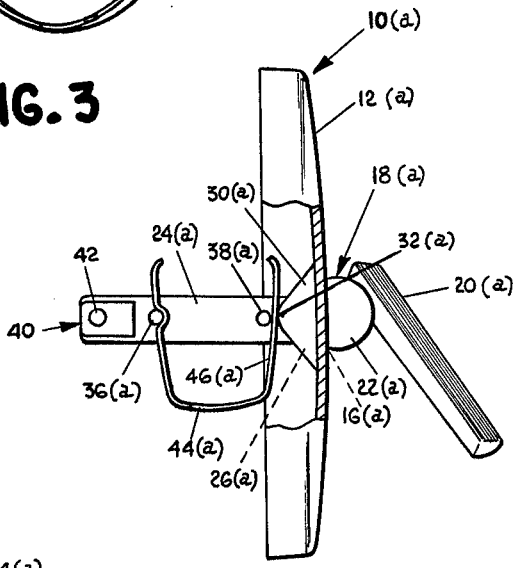
FIG. 6 is a partially broken side elevational view of a second embodiment of the invention in an unstable midway position.
Figure 7:
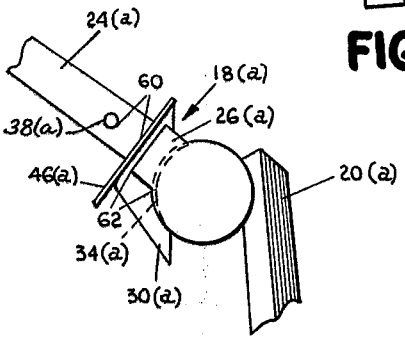
FIG. 7 is an enlarged fragmentary and broken view of the second embodiment.

In another embodiment 10(*a*) shown in FIGS. 6 and 7, retaining pin 38(*a*) is placed on arm portion 24(*a*) so that when arm portion 24(*a*) is horizontal and spring clip 44(*a*) has leg 46(*a*) in contact with apex 32(*a*) of protrusion 38(*a*), retaining pin 38(*a*) is adjacent to leg 46(*a*).

As indicated in FIG. 7, the maximum distance 60 between protuberance 38(*a*) and spring clip leg 46(*a*) which is in contact with the edge surfaces of protrusions 30(*a*) is less than the distance 62 between the rear of squared portion 26(*a*) of arm portion 24(*a*) and the indented edges 34(*a*) of protrusion 30(*a*). When retaining pin 38(*a*) is positioned within the maximum distance 60, any forward pull on handle 20(*a*) and subsequent maneuvers by an operator is incapable of bringing trip lever 18(*a*) to a position where it can be rotated. The elimination of any rotation eliminates any possibility that retaining pin 38(*a*) and securing pin 36(*a*) can be rotated so that they are aligned with the slots in spring clip 44(*a*) so that spring clip 44(*a*) disengages with arm portion 24(*a*) rendering trip lever 18(*a*) ineffective.

The invention thus provides a position lock for a trip lever in a spring biased waste and overflow plate assembly with a slotted U-shaped spring. The lock is provided simply, inexpensively and without any interference to the assembly process.

It should be understood that the foregoing embodiments of the invention are merely illustrative of the preferred practice of the invention and that various changes and modifications may be made in the arrangements and details of construction of the embodiments described herein without departing from the spirit and scope of the invention.

The embodiments of the invention in which an exclusive property or privilege is claimed are defined as follows:

1. In a waste and overflow plate assembly having: a face plate having an aperture therethrough; a trip lever positioned through the aperture of the face plate and movable between two pivotable positions with respect to the face plate; the trip lever having a handle and arm portions; means for toggling the trip lever between the two pivotable positions on the face plate, the toggle means including a spring clip having a front leg section and a rear leg section, each of which have a slotted aperture therethrough, and means on an end of the trip lever biasing the spring between an end of the trip lever and the face plate; stabilizing means to prevent rotation of the trip lever with respect to the face plate when the trip lever is seated in a seating means on the face plate but to permit rotation of the trip lever with respect to the face plate when the trip lever is unseated therefrom to facilitate assembly of the trip lever to the face plate; the improvement which comprises:

retaining means on the trip lever and spaced sufficiently close to the face plate for preventing withdrawal of the trip lever from engagement with the face plate while facilitating the trip lever toggle between the two pivotable positions wherein the retaining means has a front protuberance transverse to the slotted aperture of the frong leg of the spring clip, the front protuberance has a length greater than the width of the slotted aperture, and the front leg of the spring clip is positioned between the front protuberance and the face plate so that the protuberance abuts the front leg of the spring clip when the trip lever is pulled forward.

2. A waste and overflow assembly as defined in claim 1 wherein the aperture of the face plate extends through the seating means; the toggle means includes a ball portion on the trip lever which is pivotably seated on the face plate, protrusions extend rearwardly from the face plate, and the spring clip biased against the protrusions; the stabilizing means comprises a squared portion of the trip lever adjacent and to the rear of the ball portion, the sides of the squared portion are adjacent to the inside surfaces of the protrusions.

3. A waste and overflow assembly as defined in claim 2 wherein the front protuberance is positioned on the arm portion so that the minimum distance between the protrusions and protuberance is equal to the thickness of the front leg of the spring clip so that the protuberance will not interfere with the toggle means and the maximum distance between the protuberance and protrusions is less than the distance from the rear edges of the squared portion of the arm portion to the frontward edges of the protrusions so that when the trip lever is pulled forward the protuberance will abut the front leg of the spring clip before the squared portion can be unseated from the face plate.

4. A waste and overflow assembly as defined in claim 2 wherein the seating means is a circular socket, the protrusions are flat and triangular in shape, have their planes parallel to each other and transverse to the face plate and have their inner surfaces aligned within the circumference of the circular socket.

5. A waste and overflow assembly as defined in claim 4 wherein the front edges of the protrusions are indented and sloped to conform with the circular socket.

6. A waste and overflow assembly as defined in claim 5 wherein the length of the protuberance is less than the diameter of the circular socket but greater than the distance between the protrusions.

7. A waste and overflow assembly as defined in claim 3 wherein the front protuberance has a length greater than the distance between the protrusions and is positioned transverse to the planes of the protrusions.

* * * * *